US010876236B2

(12) United States Patent
Yoshida et al.

(10) Patent No.: US 10,876,236 B2
(45) Date of Patent: Dec. 29, 2020

(54) PRESSER FOOT DEVICE

(71) Applicant: BROTHER KOGYO KABUSHIKI KAISHA, Nagoya (JP)

(72) Inventors: Masaki Yoshida, Nagoya (JP); Nobuhiko Funato, Gifu (JP); Takuya Nakamura, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 9 days.

(21) Appl. No.: 16/385,434

(22) Filed: Apr. 16, 2019

(65) Prior Publication Data

US 2019/0330776 A1 Oct. 31, 2019

(30) Foreign Application Priority Data

Apr. 27, 2018 (JP) ..... 2018-086677

(51) Int. Cl.

| | |
|---|---|
| ***D05B 29/12*** | (2006.01) |
| ***D05B 29/06*** | (2006.01) |
| ***D05B 3/12*** | (2006.01) |
| ***D05B 3/06*** | (2006.01) |

(52) U.S. Cl.

CPC ..... *D05B 29/06* (2013.01); *D05B 3/06* (2013.01); *D05B 3/12* (2013.01); *D05B 29/12* (2013.01); *D05D 2303/14* (2013.01)

(58) Field of Classification Search

CPC ..... D05B 3/08; D05B 37/02; D05B 29/06; D05B 3/14; D05B 3/06; D05B 29/12

See application file for complete search history.

(56) References Cited

U.S. PATENT DOCUMENTS

| | | | | |
|---|---|---|---|---|
| 3,724,407 | A * | 4/1973 | Simon | D05B 29/06 112/240 |
| 3,854,433 | A * | 12/1974 | Hanyu | D05B 29/06 112/235 |
| 4,548,145 | A * | 10/1985 | Hirose | D05B 29/12 112/151 |
| 2007/0266920 | A1* | 11/2007 | Fujihara | D05B 29/12 112/313 |
| 2008/0264318 | A1* | 10/2008 | Mori | D05B 27/02 112/470.03 |
| 2015/0090169 | A1 | 4/2015 | Okada et al. | |
| 2019/0112738 | A1* | 4/2019 | Iwasaki | D05B 83/00 |

FOREIGN PATENT DOCUMENTS

JP 2015-66228 A 4/2015

* cited by examiner

*Primary Examiner* — Tajash D Patel
(74) *Attorney, Agent, or Firm* — Oliff PLC

(57) ABSTRACT

A presser foot device includes a wall portion, a pair of opposed portions, a pin, and an abutting portion. The wall portion extends in a first direction and a second direction intersecting the first direction. The pair of opposed portions extend in one direction of a third direction intersecting the first direction and the second direction from the wall portion, and face each other. The pin extends in the second direction between the pair of opposed portions, and engages with a groove provided in the presser foot holder. The abutting portion is provided with respect to the pin on one direction side of the first direction, and is provided on the one direction side of the third direction of an end surface in the one direction of the third direction, of the pair of opposed portions. The abutting portion abuts against the presser foot holder in the second direction.

13 Claims, 7 Drawing Sheets

PRESSER FOOT DEVICE

CROSS-REFERENCE TO RELATED APPLICATION

This application claims priority to Japanese Patent Application No. 2018-086677, filed Apr. 27, 2018, the content of which is hereby incorporated by reference.

BACKGROUND

The present disclosure relates to a presser foot device mounted on a presser foot holder of a sewing machine.

A presser foot device mounted on a presser foot holder of a sewing machine is known. The known presser foot device is mounted on the presser foot holder of the sewing machine when sewing a button hole. The presser foot device includes a rectangular metal plate, and a presser foot. The rectangular metal plate holds cloth against a needle plate of the sewing machine. The presser foot is connected to the rectangular metal plate so as to be able to move in the longitudinal direction of the rectangular metal plate. The presser foot includes a pair of opposed protrusions that face each other in the lateral direction of the rectangular metal plate, and a pin that extends between the pair of opposed protrusions. The presser foot device is mounted on the presser foot holder by the pin being fitted into a transverse groove provided on the lower surface of the presser foot holder. When the sewing machine sews a button hole, the cloth is fed by a feed dog of the sewing machine that protrudes from the needle plate, and the rectangular metal plate follows the movement of the cloth.

SUMMARY

The presser foot device is mounted to the presser foot holder by only the engagement of the pin in the transverse groove. Therefore, when sewing, the presser foot device may jounce and tilt with respect to the presser foot holder if upward force acting on the rectangular metal plate becomes unequal between one end side and the other end side in the lateral direction of the rectangular metal plate. In this case, the sewing machine will end up feeding the cloth at an angle with respect to the ideal feed direction.

Embodiments of the broad principles derived herein provide a presser foot device that inhibits jouncing with respect to a presser foot holder.

Exemplary embodiments herein provide a presser foot device mounted to a presser foot holder of a sewing machine including a wall portion, a pair of opposed portions, a pin, and an abutting portion. The wall portion extends in a first direction and a second direction. The first direction intersects the second direction. The pair of opposed portions extend in one direction of a third direction from the wall portion, and face each other. The third direction intersects the first direction and the second direction. The pin extends in the second direction between the pair of opposed portions, and is configured to engage with a groove provided in the presser foot holder. The abutting portion is provided with respect to the pin on one direction side of the first direction, and is provided on the one direction side of the third direction of an end surface in the one direction of the third direction, of the pair of opposed portions. The abutting portion is configured to abut against the presser foot holder in the second direction.

BRIEF DESCRIPTION OF THE DRAWINGS

Embodiments of the disclosure will be described below in detail with reference to the accompanying drawings in which.

DETAILED DESCRIPTION OF THE EXEMPLARY EMBODIMENTS

Figure 1:
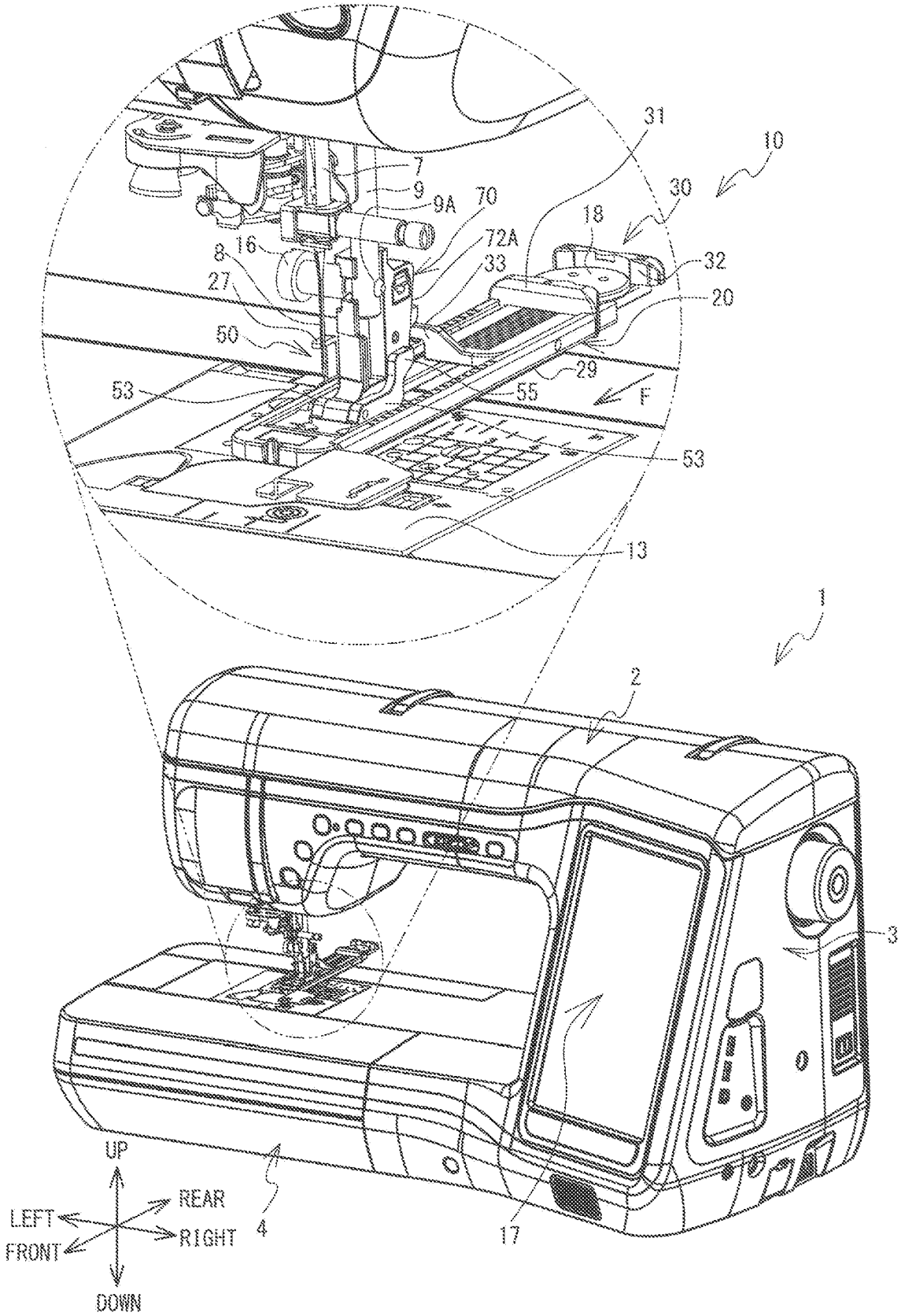
FIG. 1 is a perspective view of a sewing machine 1.

A presser foot device 10 which is one example of an embodiment of the present disclosure will now be described. The presser foot device 10 is mounted on a sewing machine 1. In the description below, the front-rear direction, the left-right direction, and the up-down direction indicated by the arrows in the drawings will be used.

As shown in FIG. 1, the sewing machine 1 has a bed portion 4, a pillar 3, and an arm portion 2. The pillar 3 extends upward from the bed portion 4. The arm portion 2 extends toward the left from an upper end portion of the pillar 3. A needle plate 13 is provided on the bed portion 4. Cloth (not shown in the drawings) is placed on the needle plate 13. A needle hole (not shown in the drawings) and a feed dog hole (not shown in the drawings) are provided in the needle plate 13. A shuttle mechanism. (not shown in the drawings) and a feed mechanism (not shown in the drawings) are provided inside the bed portion 4. A shuttle of the shuttle mechanism is disposed below the needle hole, and houses a bobbin around which a lower thread is wound. The feed mechanism includes the feed dog and a feed motor. The feed dog oscillates from the driving force of the feed motor. The oscillating feed dog feeds the cloth in the front-rear direction when protruding from the feed dog hole. The oscillating direction of the feed dog is switched by switching the driving direction of the feed motor.

An operating unit 17 is provided in the pillar 3. The operating unit 17 includes a liquid crystal display, and a touch panel provided on a surface of the liquid crystal display. A user can input various kinds of information to the sewing machine 1 by operating the operating unit 17.

A main shaft (not shown in the drawings) that rotates by the driving of a sewing machine motor (not shown in the drawings) is provided inside the arm portion 2. A needle bar 7 that moves up and down with the rotation of the main shaft is provided on a left end portion of the arm portion 2. A sewing needle 8 is mounted on the lower end of the needle bar 7. An upper thread (not shown in the drawings) is inserted through an eye (not shown in the drawings) formed in a lower end portion of the sewing needle 8. The sewing needle 8 passes through the needle hole as the needle bar 7 moves up and down. The upper thread is captured by the shuttle that is driven in conjunction with the needle bar 7, and is then entwined with the lower thread that is drawn out from the bobbin. A needle drive mechanism (not shown in the drawings) is provided inside the arm portion 2. When a needle drive motor of the needle drive mechanism is driven, the needle drive mechanism consequently causes the needle bar 7 to oscillate in the left-right direction.

A detection switch (not shown in the drawings) is provided on the left end portion of the arm portion 2. The detection switch includes an L-shaped abutting portion. The L-shaped abutting portion extends downward from the arm portion 2 and then bends to the right. The L-shaped abutting portion is disposed between a detected portion 33 (refer to FIG. 3), described later, and a protruding portion 27 (refer to FIG. 3), in the front-rear direction, and is able to abut with the detected portion 33 and the protruding portion 27. The detection result from the detection switch switches depending on whether the L-shaped abutting portion is abutted against the detected portion 33 or the protruding portion 27.

A presser bar 9 that extends in the up-down direction is provided on the left end portion of the arm portion 2. The presser bar 9 is linked to an adjustment lever (not shown in the drawings) provided on the arm portion 2. The user adjusts the position of the presser bar 9 in the up-down direction by operating the adjustment lever.

Figure 2:
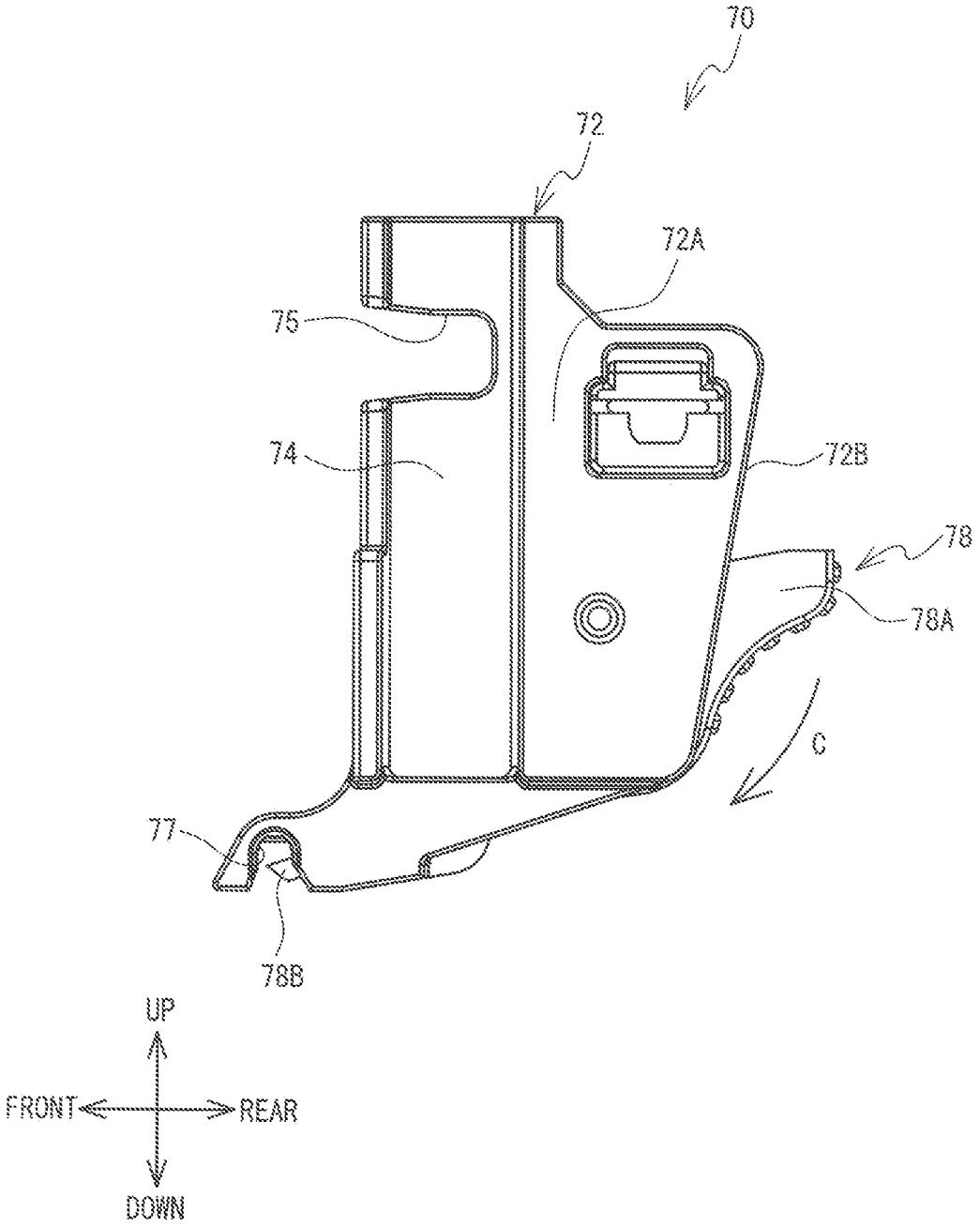
FIG. 2 is a right side view of a presser foot holder 70.

A presser foot holder 70 is retained on a lower end of the presser bar 9, as shown in FIG. 1 and FIG. 2. The presser foot holder 70 includes a base portion 72, an insertion recess 74, and an insertion hole 75. The base portion 72 extends in the up-down direction and has a generally rectangular shape when viewed from the side. A rear portion of the base portion 72 is formed by a pair of side wall portions 72A that face each other across a space in the left-right direction. In the present embodiment, end portions 72B in the rear direction of the pair of side wall portions 72A are a rear end portion of the base portion 72. The insertion recess 74 is disposed forward of the pair of side wall portions 72A. The insertion recess 74 is provided in the right surface of the base portion 72 and is recessed toward the left. The presser bar 9 is inserted inside the insertion recess 74. The insertion hole 75 is disposed forward of the pair of side wall portions 72A, and passes through the base portion 72 in the left-right direction. The right end of the insertion hole 75 is formed in the inside left surface of the insertion recess 74, and faces the presser bar 9. A screw 16 is inserted into the insertion hole 75, and fastened to a screw hole 9A formed in the presser bar 9. As a result, the presser foot holder 70 is retained by the lower end of the presser bar 9.

A groove 77 is provided in a front lower portion of the base portion 72. The groove 77 opens downward and extends in the left-right direction. The groove 77 is generally circular when viewed from the right side. One end of a pin hole (not shown in the drawings) is formed in an inside rear surface of the groove 77. The pin hole is a hole that extends toward the rear from the inside rear surface of the groove 77, and is disposed between the pair of side wall portions 72A, in the left-right direction.

A holder lever 78 is provided between the pair of side wall portions 72A. The holder lever 78 is able to rotate with the left-right direction as the axial direction. The holder lever 78 includes a protruding portion 78A and a retaining pin 78B. The protruding portion 78A is a portion that can be operated by the user and protrudes toward the rear from the side wall portions 72A. The retaining pin 78B extends linearly and is inserted into the pin hole of the groove 77. The holder lever 78 is urged in the clockwise direction (in the direction of arrow C) when viewed from the right side, by an elastic member (not shown in the drawings) provided on the base portion 72. As a result, the retaining pin 78B is retained in a position in which the from end portion of the retaining pin 78B enters the inner region of the groove 77. When the user rotates the holder lever 78 against the urging direction of the elastic member, the front end portion of the retaining pin 78B is drawn into the pin hole.

The configuration of the presser foot device 10 will now be described with reference to FIG. 1 and FIG. 3 to FIG. 7. The presser foot device 10 is a device that is mounted on the presser foot holder 70, and holds the cloth against the needle plate 13. The presser foot device 10 of the present embodiment is able to hold a button 18. When the sewing machine 1 sews a button hole (also referred to as "button holing"), the presser foot device 10 is mounted to the presser foot holder 70. In the following description of the structure of the presser foot device 10, the presser foot device 10 is in a state mounted to the presser foot holder 70.

Figure 3:
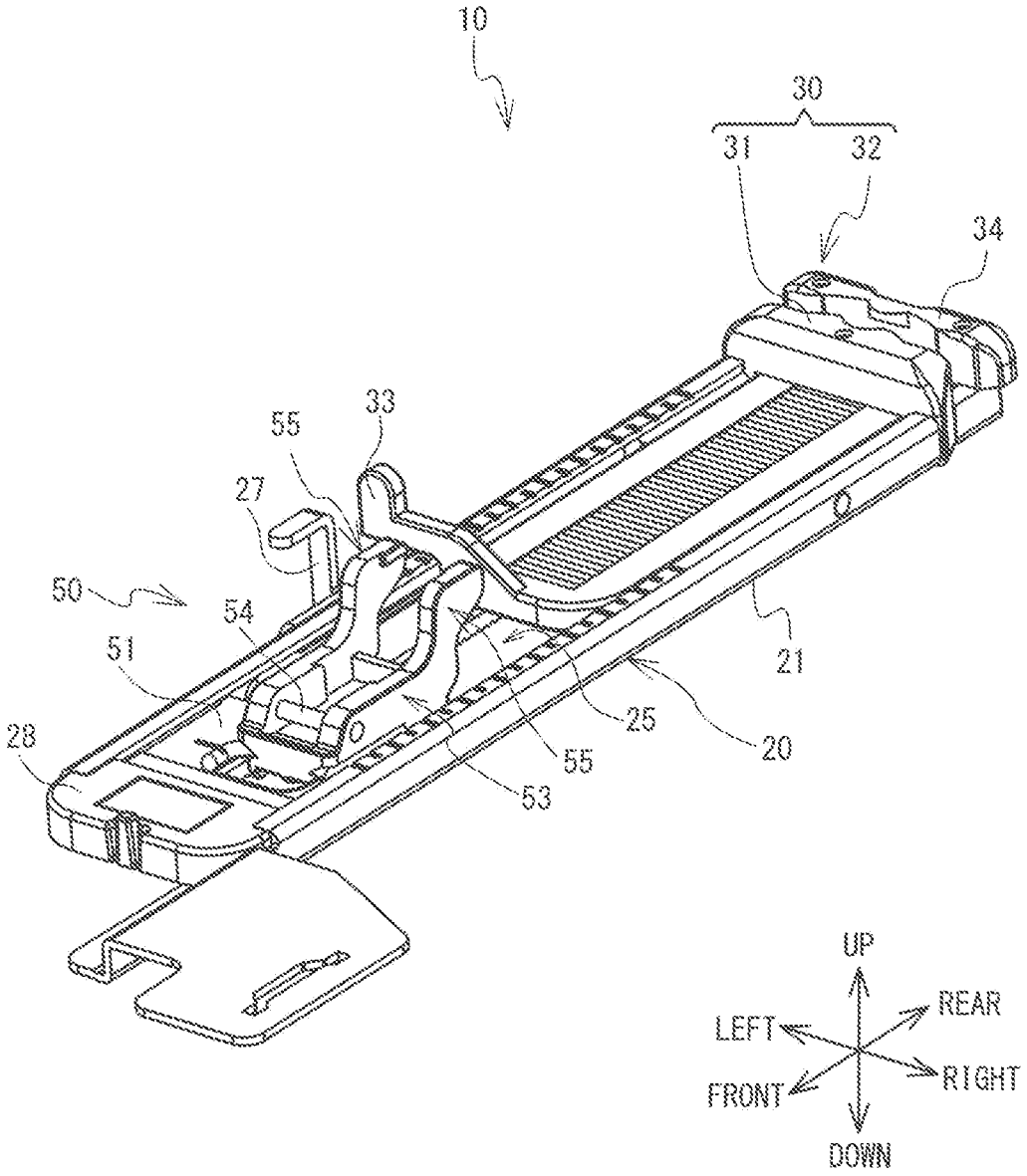
FIG. 3 is a perspective view of a presser foot device 10.

As shown in FIG. 3, the presser foot device 10 includes a holder portion 20, a button holding portion 30, and a mounting portion 50. The presser foot device 10 is mounted to the presser foot holder 70 (refer to FIG. 1) via the mounting portion 50, as will be described later.

Figure 4:
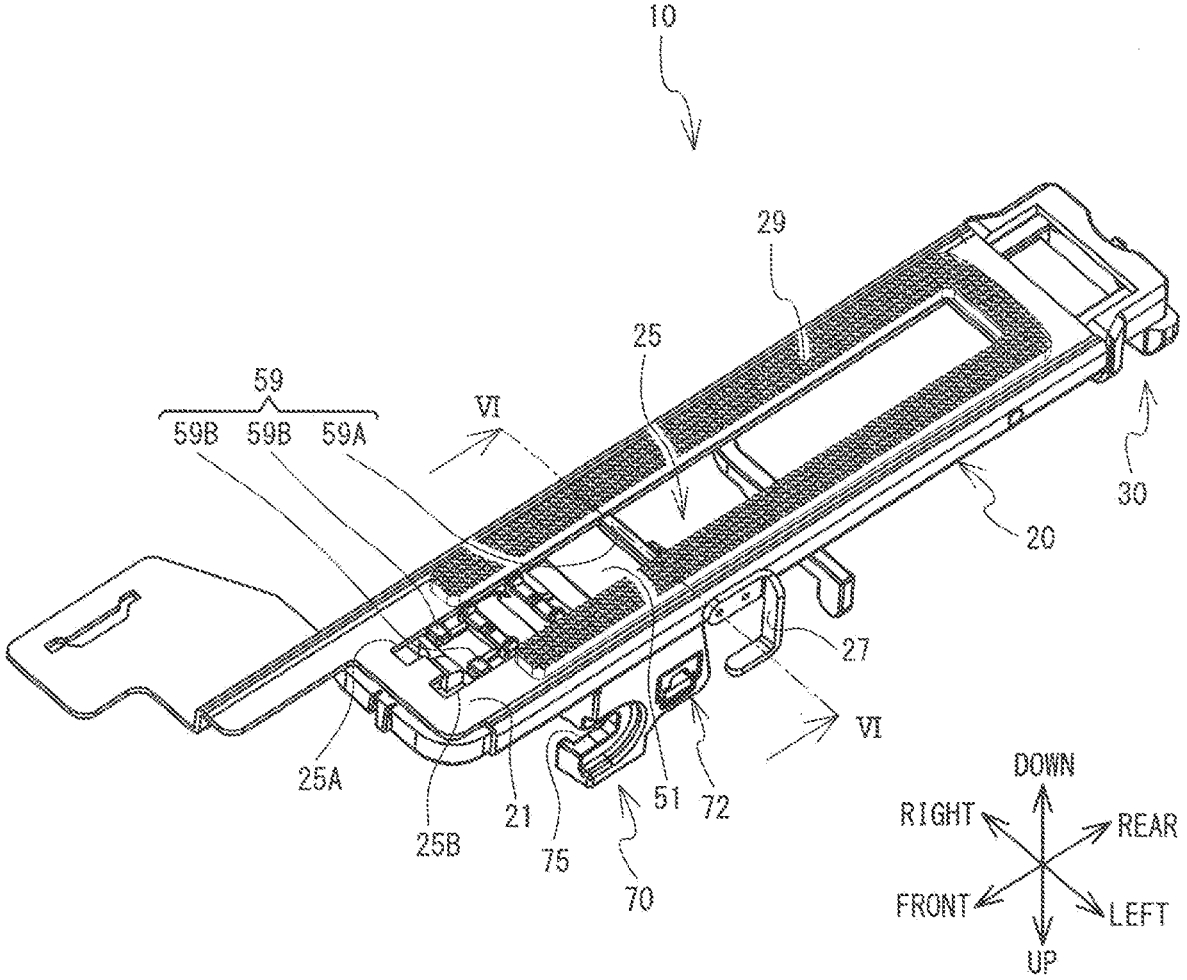
FIG. 4 is another perspective view of the presser foot device 10.

As shown in FIG. 3 and FIG. 4, the holder portion 20 has a general shape when viewed from the front side, and extends in the front-rear direction. The holder portion 20 includes a plate-shaped portion 21, and an opening 25. The plate-shaped portion 21 has a thickness in the up-down direction. The opening 25 is a hole that passes through the plate-shaped portion 21 in the thickness direction. That is, the opening 25 is open in the up-down direction. The two end portions in the left-right direction of the opening 25 are one end portion 25A and the other end portion 25B. A presser foot portion 29 made of rubber material is provided on the lower surface of the plate-shaped portion 21. The lower surface of the presser foot portion 29 has an uneven shape and can hold the cloth against the needle plate 13 (refer to FIG. 1). A protruding portion 27 is provided on the holder portion 20. The protruding portion 27 protrudes upward from the holder portion 20. The protruding portion 27 faces the L-shaped abutting portion of the sewing machine 1 from the front.

The button holding portion 30 includes a fixed portion 31, and a movable portion 32. The fixed portion 31 is fixed to a rear end portion of the plate-shaped portion 21. The movable portion 32 is provided so as to be able to move forward and backward on the upper surface of the plate-shaped portion 21. The movable portion 32 includes the detected portion 33, and a movable holding portion 34. The detected portion 33 faces the L-shaped abutting portion of the sewing machine 1 from the rear. The detected portion 33 can abut against the L-shaped abutting portion of the sewing machine 1. The movable holding portion 34 is provided to the rear of the fixed portion 31. The movable holding portion 34 can hold the button 18 by sandwiching the button 18 with the fixed portion 31 (refer to FIG. 1). The user adjusts the distance between the movable holding portion 34 and the fixed portion 31 by moving the movable portion 32 in the front-rear direction according to the outer diameter of the button 18. As a result, the distance between the protruding portion 27 and the detected portion 33 changes. The length dimension of the button hole when the button hole is finished being sewn is determined by this distance. The maximum outer diameter of the button 18 that can be held by the button holding portion 30 is approximately 50 mm, for example.

Figure 5:
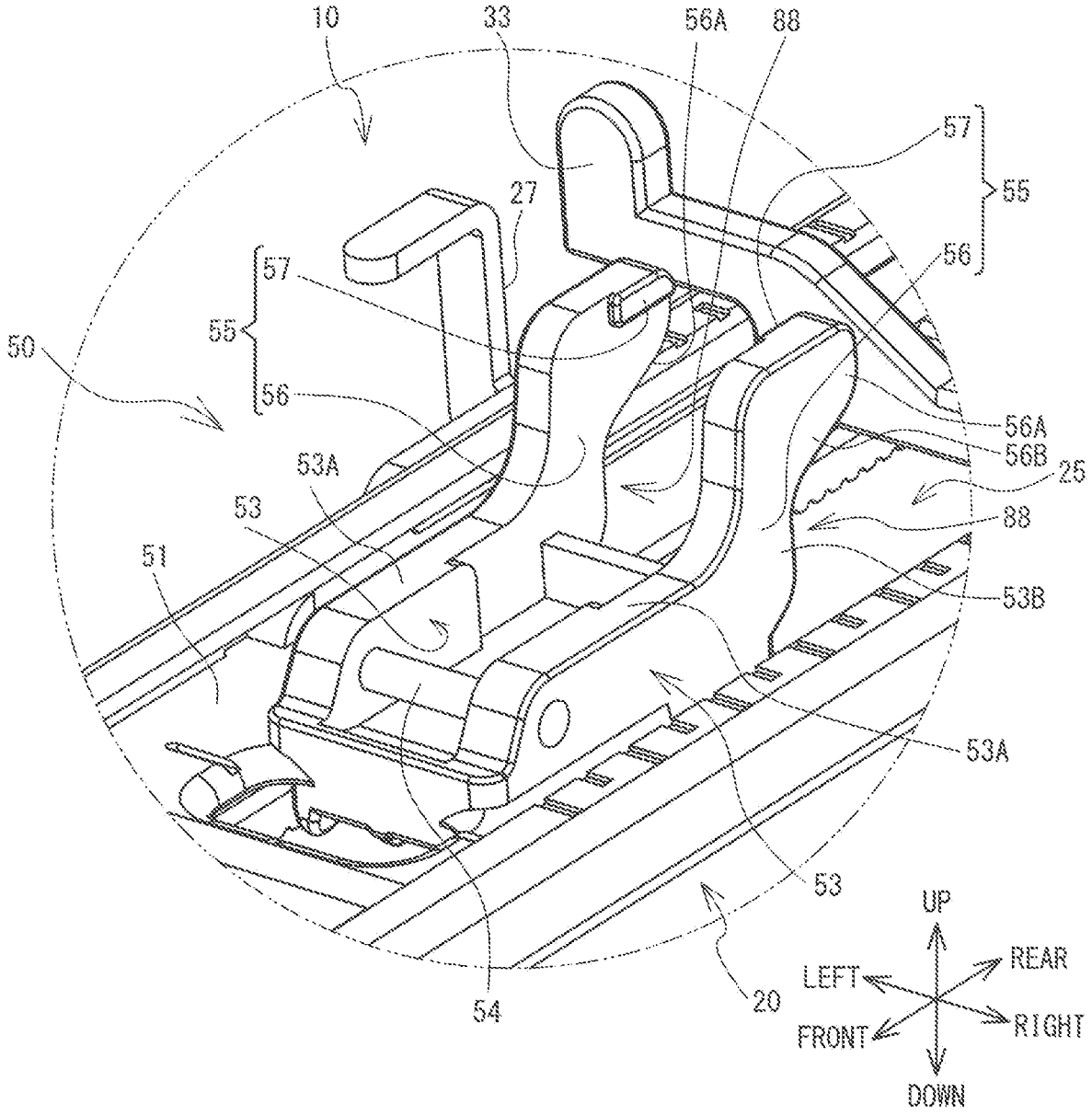
FIG. 5 is an enlarged perspective view of a mounting portion 05.
Figure 6:
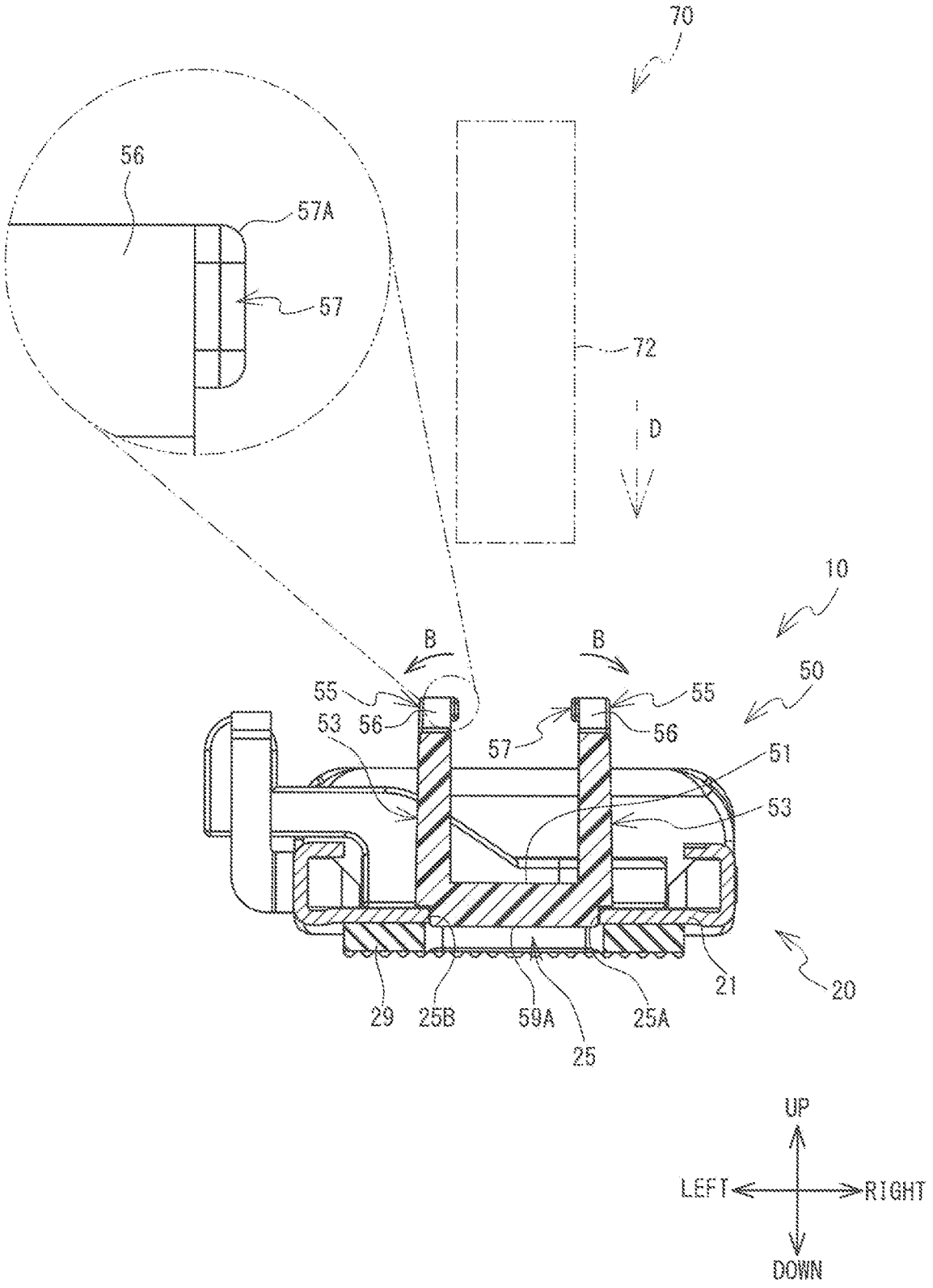
FIG. 6 is a sectional view of the presser foot device 10 taken along line VI-VI in FIG. 4.

As shown in FIG. 5 and FIG. 6, the mounting portion 50 includes a wall portion 51, an insertion portion 59 (refer to FIG. 4), a pair of opposed portions 53, a pin 54, and a pair of abutting portions 55. In the present embodiment, as an example, the wall portion 51, the insertion portion 59, the pair of opposed portions 53, and the pair of abutting portions 55 are integrally formed together by resin material. The wall portion 51 is provided so as to be able to move forward and backward on the upper surface of the plate-shaped portion 21. In other words, the wall portion 51 is held by the holder portion 20 so as to be able to move in the front-rear direction. The wall portion 51 covers a portion of the opening 25 from above. The wall portion 51 is urged toward the front by an urging member (not shown in the drawings). The urging member of the present embodiment is a flat spiral spring that is connected to the wall portion 51, and is wound inside an accommodation portion 28 (refer to FIG. 3) provided in the front end of the plate-shaped portion 21.

As shown in FIG. 4, the insertion portion 59 protrudes downward from the wall portion 51 and is inserted into the opening 25. The insertion portion 59 includes a first insertion portion 59A, and a pair of second insertion portions 59B. The first insertion portion 59A is provided on a rear end portion of the wall portion 51, and extends linearly in the left-right direction. The pair of second insertion portions 59B are provided spaced apart from each other in the left-right direction, at the front end portion of the wall portion 51. The two end portions in the left-right direction of the first insertion portion 59A abut against the one end portion 25A and the other end portion 25B of the opening 25, respectively (refer to FIG. 6). The second insertion portion 59B on the right side abuts against the one end portion 25A, and the second insertion portion 59B on the left side abuts against the other end portion 25B of the opening 25. That is, the insertion portion 59 abuts against both the one end portion 25A and the other end portion 25B of the opening 25. Therefore, the wall portion 51 will not easily jounce with respect to the opening 25.

As shown in FIG. 5, the pair of opposed portions 53 each extend upward from the wall portion 51. The pair of opposed portions 53 are arranged facing each other in the left-right direction, on the outside in the left-right direction with respect to the presser bar 9 (refer to FIG. 1). The end surfaces (that is, the upper end surfaces) of the opposed portions 53 in the upward direction are end surfaces 53A. The end surfaces 53A are flat surfaces that extend in the front-rear direction. The pin 54 extends in the left-right direction between the pair of opposed portions 53, on the front side of the presser bar 9 (refer to FIG. 1). The outer diameter of the pin 54 is smaller than the inner diameter of the groove 77 (refer to FIG. 2). The pin 54 is fitted in the groove 77. The pin 54 is squeezed between the inside upper surface of the groove 77 and the front end portion of the retaining pin 78B, in the up-down direction. As a result, the pin 54 is engaged with the groove 77. Note that in the present embodiment, the pin 54 is a round bar, but the pin 54 may also be a square bar. The pin 54 can be any shape as long as the shape enables the pin 54 to be engaged with the groove 77.

The pair of abutting portions 55 are provided on the rearward side with respect to the pin 54, and are provided higher than the end surfaces 53A of the opposed portions 53. In the present embodiment, the pair of abutting portions 55 extend upward from the rear portions of the pair of opposed portions 53, respectively. The rear portions of the opposed portions 53 are portions of the opposed portions 53 that are to the rear side of the pin 54. In the present embodiment, the abutting portions 55 extend upward from portions of the opposed portions 53 that are to the rear side of the front end portion of the presser bar 9. At least a portion of the abutting portions 55 is to the rearward side of the presser bar 9. In the present embodiment, the front end portions of the abutting portions 55 are arranged in the same position as the presser bar 9 in the front-rear direction, and the rear portions of the abutting portions 55 are arranged to the rearward side of the presser bar 9 (refer to FIG. 1). Preferably, the front end portions of the abutting portions 55 may be to the rearward side of the center position in the front-rear direction of the presser bar 9. Also, the abutting portions 55 are to the forward side of the end portion 72B of the base portion 72 of the presser foot holder 70 (refer to FIG. 7). A portion of the abutting portions 55 is provided in the same position as the first insertion portion 59A, in the front-rear direction (refer to FIG. 7). In other words, the insertion portion 59 is provided in the same position as at least a portion of the abutting portions 55, in the front-rear direction.

The abutting portions 55 each include a specific wall portion 56, and a protruding portion 57. The specific wall portion 56 extends upward from the end surface 53A of the opposed portion 53. The specific wall portion 56 includes a first end portion 56A, and a second end portion 56B. The first end portion 56A is an end portion in the rear direction of the specific wall portion 56, and extends in the up-down direction. The first end portion 56A is on the rearward side and upward side of the end portion 53B in the rear direction of the opposed portion 53. A space 88 is formed below the first end portion 56A and to the rear of the end portion 53B. The second end portion 56B connects the first end portion 56A to the end portion 53B, and is inclined with respect to the up-down direction and the front-rear direction.

The protruding portion 57 protrudes from the specific wall portion 56 in the direction toward the center position between the pairs of opposed portions 53, in the left-right direction. The pair of protruding portions 57 abut from the outside in the left-right direction against the pair of side wall portions 72A of the presser foot holder 70, respectively. Each of the protruding portions 57 includes an inclined surface 57A (refer to FIG. 6). The inclined surface 57A is a curved surface that inclines in the direction in which the protruding portion 57 protrudes, as the curved surface goes downward. The upper end of the inclined surface 57A of the present embodiment is at the same position as the upper end of the specific wall portion 56, in the up-down direction.

The relationship between the length of the opposed portions 53 and the length of the abutting portions 55 will now be described with reference to FIG. 7. The length in the up-down direction of the opposed portions 53 corresponds to dimension L1, and the length in the up-down direction of the abutting portions 55 corresponds to dimension M1. The length in the front-rear direction of the opposed portions 53 corresponds to dimension L2, the length in the front-rear direction of the end surfaces 53A of the opposed portion 53 corresponds to dimension L3, and the length in the front-rear direction of the abutting portions 55 corresponds to dimension M2. The dimension L1 is the dimension from the upper surface of the wall portion 51 to the end surfaces 53A, in the up-down direction. The dimension M1 is the dimension from the end surfaces 53A to the upper ends of the abutting portions 55, in the up-down direction. The dimension M1 is longer than the dimension L1. In other words, the abutting portions 55 are longer than the pair of opposed portions 53 in the up-down direction. The dimension L3 is the dimension from the front ends of the opposed portions 53 to the rear ends of the planar end surfaces 53A, in the front-rear direction. The dimension M2 is the dimension from the rear ends of the end surfaces 53A to the rear ends of the abutting portions 55, in the up-down direction. The dimension M2 is shorter than the dimensions L2 and L3. In other words, the abutting portions 55 are shorter than the pair of opposed portions 53, and shorter than the pair of end surfaces 53A, in the front-rear direction.

Heretofore, the structure of the presser foot device 10 in a state in which the presser foot holder 70 is mounted to the presser foot device 10 has been described. However, when the presser foot device 10 is detached from the presser foot holder 70, the front-rear direction, the left-right direction, and the up-down direction used in the description of the structure of the presser foot device 10 can be changed to any directions.

The operation by which the sewing machine 1 sews a button hole will now be described with reference to FIG. 1, FIG. 2, FIG. 6, and FIG. 7. In FIG. 6, a frame format of the base portion 72 of the presser foot holder 70 is shown by a long and two short dashes line, and the presser bar 9 (refer to FIG. 1) is not shown in FIG. 7. Before sewing the button hole, the presser bar 9 is arranged at the upper end of the movable range, and the presser foot holder 70 is held on the presser bar 9. The presser foot device 10 is detached from the presser foot holder 70.

The user moves the movable portion 32 so that the button 18 is sandwiched between the movable holding portion 34 and the fixed portion 31. As a result, the button holding portion 30 holds the button 18. The user places the presser foot device 10 on the needle plate 13 (refer to FIG. 1). The pin 54 (refer to FIG. 3) of the presser foot device 10 is arranged directly below the groove 77 of the presser foot holder 70. The pair of protruding portions 57 are arranged directly below the base portion 72.

When the user operates the adjustment lever, the presser bar 9 consequently moves downward. As a result, the base portion 72 moves downward (arrow D in FIG. 6). The lower end portions of the pair of side wall portions 72A abut against the pair of inclined surfaces 57A, respectively. As the side wall portions 72A slide on the inclined surfaces 57A, the pair of specific wall portions 56 bend toward the outsides in the left-right direction (arrow B FIG. 6). The lower end portions of the side wall portions 72A move downward beyond the inclined surfaces 57A, and then the pin 54 is fitted inside the groove 77. The pin 54 abuts against the front end portion of the retaining pin 78B that is in the groove 77, and moreover causes the retaining pin 78B to move upward and toward the rear against the urging force of the elastic member, which in turn causes the holder lever 78 to rotate counterclockwise when viewed from the right side. When the front end portion of the retaining pin 78B moves below the pin 54, the front end portion of the retaining pin 78B moves to a position directly below the pin 54 by the urging force of the elastic member. Simultaneously, the upper portion of the pin 54 abuts against the inside upper surface of the groove 77. The pin 54 is then sandwiched from above and below by the front end portion of the retaining pin 78B and the inside upper surface of the groove 77. As a result, the pin 54 engages with the groove 77. At this time, the pair of protruding portions 57 press against the pair of side wall portions 72A of the base portion 72 from the outsides in the left-right direction due to the restoring force of the pair of specific wall portions 56 that are in the bent state. The presser foot device 10 is mounted to the presser foot holder 70 by the pin 54 engaging with the groove 77, and the pair of protruding portions 57 pressing against the base portion 72.

When the user operates the adjustment lever and moves the presser bar 9 upward, the presser foot device 10 moves upward away from the needle plate 13. After cloth has been placed on the needle plate 13, the user operates the adjustment lever again and moves the presser bar 9 downward. As a result, the cloth (not shown in the drawings) is sandwiched between the presser foot portion 29 of the presser foot device 10 and the needle plate 13 (refer to FIG. 1). At this time, the protruding portion 27 of the presser foot device 10 abuts against the L-shaped abutting portion from the front.

When the user inputs an instruction to start sewing to the operating unit 17, the sewing machine 1 consequently drives the sewing machine motor, the feed motor, and the needle drive motor and the like in synchronization with each other. The feed dog feeds the cloth forward (arrow F in FIG. 1), and the holder portion 20 of the presser foot device 10 moves forward along with the cloth, and the protruding portion 27 moves forward of the L-shaped abutting portion. At this time, the mounting portion 50 that is mounted to the presser foot holder 70 does not more forward. As the holder portion 20 moves, the one end portion 25A and the other end portion 25B of the opening 25 slide with respect to the insertion portion 59 of the mounting portion 50. While the cloth is fed forward, the sewing needle 8 moves up and down in conjunction with the shuttle, and forms a predetermined stitch in the cloth.

The detected portion 33 moves forward together with the holder portion 20, and abuts against the L-shaped abutting portion from the rear. When the detection result from the detection switch switches, the driving direction of the feed motor switches. The feed dog moves the cloth rearward, and the holder portion 20 moves rearward along with the cloth. Then, the protruding portion 27 abuts against the L-shaped abutting portion from the front, and the driving direction of the feed motor switches again. After moving the cloth reciprocally a predetermined number of times, the sewing machine 1 stops driving the various motors. The sewing machine 1 finishes sewing the button hole. The user operates the adjustment lever to move the presser foot device 10 upward away from the cloth.

Figure 7:
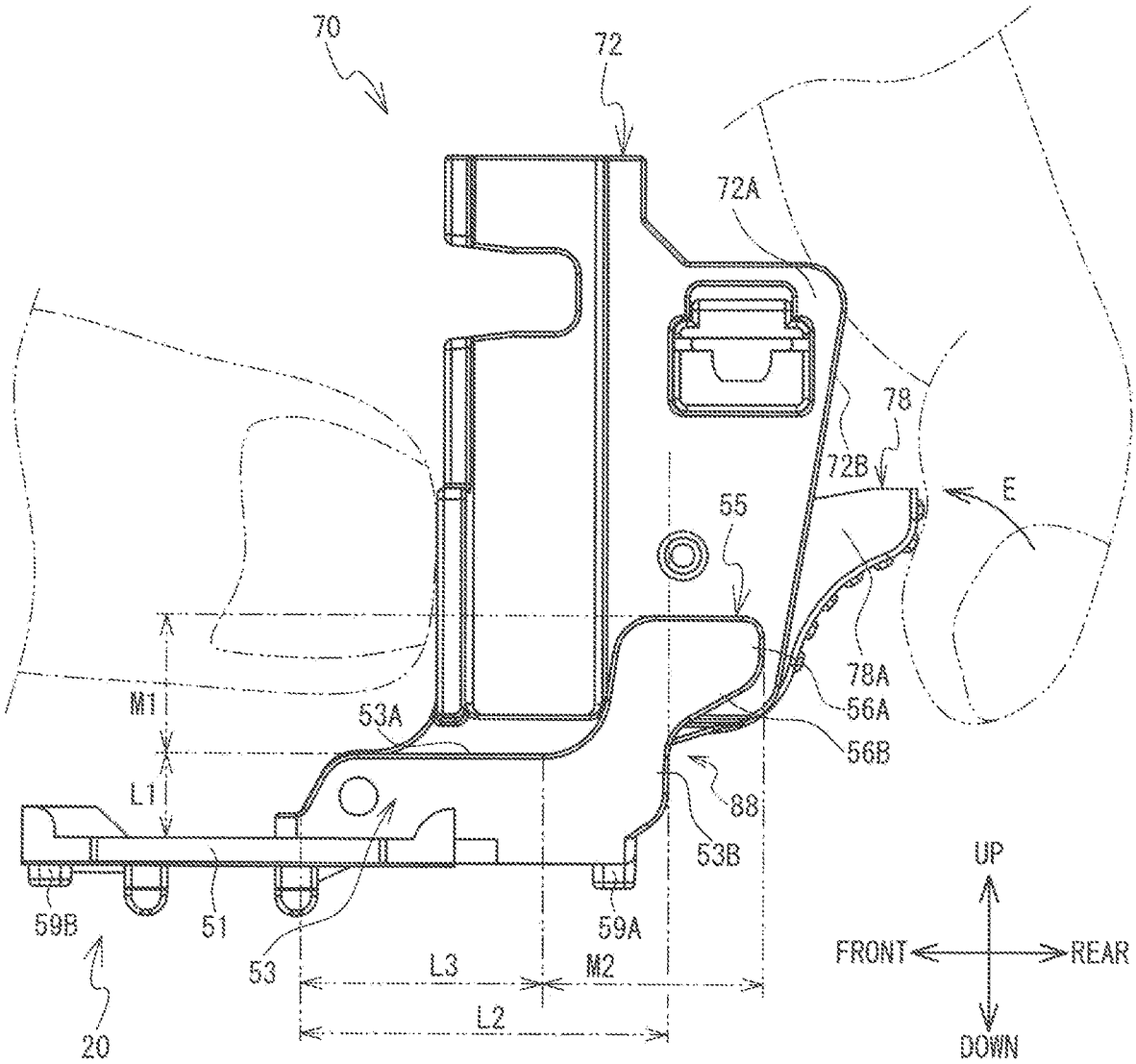
FIG. 7 is a right side view of the presser foot holder 70 and a holder portion 20.

As shown in FIG. 7, the user pinches the base portion 72 and rotates the protruding portion 78A counterclockwise, when viewed from the right side, with his or her fingers (arrow E). The front end portion of the retaining pin 78B (refer to FIG. 2), is drawn into the pin hole in the groove 77 and recedes from the inner region of the groove 77. As a result, the pin 54 disengages from the groove 77, and the presser foot device 10 detaches from the presser foot holder 70.

As described above, when the presser foot device 10 is mounted on the presser foot holder 70, the protruding portions 57 of the abutting portions 55 abut against the presser foot holder 70, in addition to the pin 54 engaging with the groove 77. That is, in a state where the presser foot device 10 is mounted on the presser foot holder 70, the portion of the presser foot device 10 that abuts against the presser foot holder 70 is greater than it is with the known presser foot device, so jouncing of the presser foot device 10 with respect to the presser foot holder 70 is less. Therefore, the presser foot device 10 can inhibit jouncing with respect to the presser foot holder 70. For example, when the thickness of the cloth is different on the left and right sides of the cloth, or when only one of the presser foot portions 29 that are provided on both the left and right sides of the holder portion 20 holds down the cloth, the upward force acting on the holder portion 20 from the cloth may become unbalanced between the left and right sides of the holder portion 20. In the present embodiment, even if the sewing machine 1 sews a button hole in a state in which the upward force acting on the holder portion 20 is unbalanced between the left and right sides of the holder portion 20, the likelihood that the presser foot device 10 will jounce with respect to the presser foot holder 70 and become inclined is low. Therefore, the moving direction of the holder portion 20 when sewing the button hole is less prone to going askew with respect to the front-rear direction, so the sewing machine 1 is able to better form a stitch in the cloth.

The abutting portions 55 extend upward from the opposed portions 53. Therefore, in a state where the presser foot device 10 is mounted on the presser foot holder 70, the opposed portions 53 are less prone to jouncing with respect to the presser foot holder 70, due to the abutment between the protruding portions 57 of the abutting portions 55 and the base portion 72. The abutting portions 55 are longer than the pair of opposed portions 53 in the up-down direction, and shorter than the pair of opposed portions 53 in the front-rear direction. Therefore, the rigidity in the left-right direction of the specific wall portions 56 of the abutting portions 55 is moderately reduced. In addition, the first end portions 56A of the specific wall portions 56 are on the rearward side of the end portions 53B of the opposed portions 53, so the portions of the abutting portions 55 that connect with the opposed portions 53 (the lower end portions of the specific wall portions 56 in the present embodiment) are shorter in the front-rear direction. As a result, the rigidity in the left-right direction of the specific wall portions 56 is moderately reduced. Therefore, when the presser foot device 10 is mounted on the presser foot holder 70, the specific wall portions 56 easily bend toward the outsides in the left-right direction, so the presser foot device 10 is easily mounted on the presser foot holder 70. The space 88 is formed below the first end portion 56A and to the rear of the end portion 53B. Therefore, when the user detaches the presser foot device 10 from the presser foot holder 70, the fingers of the user abutting against the protruding portion 78A will not easily contact the presser foot device 10. Therefore, the operability of detaching the presser foot device 10 from the presser foot holder 70 improves.

The abutting portions 55 each include the protruding portion 57. In a state where the presser foot device 10 is mounted on the presser foot holder 70, the protruding portions 57 tend to be pressed against the presser foot holder 70 by the restoring force of the bent specific wall portions 56. Therefore, the presser foot device 10 can further inhibit jouncing with respect to the presser foot holder 70. In the process of mounting the presser foot device 10 on the presser foot holder 70, the specific wall portions 56 easily bend to the outsides in the left-right direction, due to the base portion 72 that moves downward abutting against the inclined surfaces 57A. As a result, the presser foot device 10 is easily mounted on the presser foot holder 70.

The insertion portion 59 abuts against both of the end portions in the left-right direction of the opening 25, so the wall portion 51 is unlikely to jounce with respect to the holder portion 20. As a result, the presser foot device 10 can further inhibit jouncing with respect to the presser foot holder 70. Therefore, when sewing the button hole, the moving direction of the holder portion 20 is less prone to going askew with respect to the front-rear direction.

The first insertion portion 59A of the insertion portion 59 is provided in the same position as the abutting portions 55, in the front-rear direction. Therefore, the first insertion portion 59A is to the rearward side away from the pin 54. In addition, when the presser foot device 10 is mounted on the presser foot holder 70, at least a portion of the abutting portions 55 is to the rearward side of the presser bar 9. Therefore, the abutting portions 55 are to the rearward side away from the pin 54. Because the first insertion portion 59A and the abutting portions 55 are to the rearward side away from the pin 54, the presser foot device 10 is more easily able to inhibit jouncing with the pin 54 as the fulcrum.

When the presser foot device 10 is mounted on the presser foot holder 70, the abutting portions 55 are to the front side of the end portion 72B of the presser foot holder 70. As a result, the protruding portion 57 more easily contacts the base portion 72 of the presser foot holder 70. Therefore, the presser foot device 10 can inhibit jouncing with respect to the presser foot holder 70.

The pair of abutting portions 55 are provided on the end surfaces 53A of the pair of opposed portions 53. Therefore, in a state in which the presser foot device 10 is mounted on the presser foot holder 70, the portion of the presser foot device 10 that abuts against the presser foot holder 70 is greater than it is with the known presser foot device. Therefore, the presser foot device 10 can further inhibit jouncing with respect to the presser foot holder 70.

The present disclosure is not limited to the embodiment described above. The presser foot device 10 does not have to be able to hold the button 18, and may be a so-called cloth presser foot such as a slip stitch presser foot, or a fastener presser foot, for example. In this case, the presser foot device 10 is mounted on the presser foot holder 70 when sewing something other than a button hole. The abutting portions 55 may extend upward from the opposed portions 53, and abut against the side wall portions 72A on the rearward side of the insertion recess 74 of the presser foot holder 70. The front end portions of the abutting portions 55 may be provided on the rearward side of the insertion recess 74. The abutting portions 55 may extend upward from the end surfaces 53A, forward of the end portions 53B of the opposed portions 53. The abutting portions 55 may extend upward from a predetermined wall portion, instead of extending upward from the end surfaces 53A. The predetermined wall portion is provided on the upper surface of the wall portion 51, in a position to the rear of the opposed portions 53. The predetermined wall portion may be the wall portion 51. In this case as well, the abutting portions 55 extend farther upward than the pair of opposed portions 53. The presser foot device 10 may include only one of the pair of abutting portions 55.

The abutting portions 55 may be shorter than the pair of opposed portions 53 in the up-down direction, and longer than the pair of opposed portions 53 in the front-rear direction. In this case, although the rigidity of the specific wall portion 56 is greater than the rigidity in the embodiment described above, if the length in the left-right direction of the specific wall portion 56 is shortened, the rigidity in the left-right direction of the specific wall portion 56 will be moderately reduced. The abutting portions 55 may be longer than the end surfaces 53A of the opposed portions 53, in the front-rear direction. Instead of the lower portions of the first end portions 56A extending upward and toward the rear from a position low and toward the front, the lower ends of the first end portions 56A may be in the same position as the upper ends of the end portions 53B of the opposed portions 53, in the up-down direction. In this case, the second end portions 56B may extend in the front-rear direction between the lower ends of the first end portions 56A and the upper ends of the end portions 53B. If the first end portions 56A are disposed to the rear of the end portions 53B of the opposed portions 53, the portions of the abutting portions 55 that connect with the opposed portions 53 become shorter in the front-rear direction, and the spaces 88 are formed below the first end portions 56A. The first end portions 56A may extend linearly upward from the end portions 53B of the opposed portions 53. The upper ends of the protruding portions 57 may be provided at a position lower than the upper ends of the specific wall portions 56 in the up-down direction.

The abutting portions 55 do not have to include the protruding portions 57. In this case, the specific wall portions 56 abut in the left-right direction against the pair of side wall portions 72A of the base portion 72. If the first end portions 56A are disposed to the rearward side of the end portions 53B of the opposed portions 53, the specific wall portions 56 will be longer in the front-rear direction, so the portion of the specific wall portions 56 that abuts against the base portion 72 will increase. Therefore, the presser foot device 10 can inhibit jouncing with respect to the presser foot holder 70. The inclined surface 57A may be formed in a planar shape instead of being curved in an arc shape. The protruding portion 57 does not have to include the inclined surface 57A.

The insertion portion 59 may include only one of the first insertion portion 59A and the pair of second insertion portions 59B. For example, when the insertion portion 59 includes only the first insertion portion 59A, the first insertion portion 59A may abut against only one of the one end portion 25A and the other end portion 25B of the opening 25, or does not have to abut against either the one end portion 25A or the other end portion 25B. The insertion portion 59 may include only the pair of second insertion portions 59B. In this case, the insertion portion 59 is disposed in a position offset to the front from the abutting portions 55, in the front-rear direction. The opening 25 may be a recessed portion that opens upward, instead of being a hole that opens in the up-down direction. The presser foot device 10 need not include either the opening 25 or the insertion portion 59.

When the presser foot device 10 is mounted on the presser foot holder 70, the abutting portions 55 may be disposed to the front side of the end portion 72B of the base portion 72, or may be disposed to the front side of the presser bar 9.

What is claimed is:

1. A presser foot device mounted to a presser foot holder of a sewing machine, comprising:

a wall portion extending in a first direction and a second direction, the first direction intersecting the second direction;

a pair of opposed portions extending in one direction of a third direction from the wall portion, and facing each other, the third direction intersecting the first direction and the second direction;

a pin extending in the second direction between the pair of opposed portions, and being configured to engage with a groove provided in the presser foot holder; and an abutting portion provided with respect to the pin on one direction side of the first direction, and provided on the one direction side of the third direction with respect to an end surface of the pair of opposed portions, the end surface being a surface provided on the one direction side of the third direction of the pair of opposed portions, the abutting portion being configured to abut against the presser foot holder in the second direction.

2. The presser foot device according to claim 1, wherein the abutting portion extends in the one direction of the third direction from the opposed portions.

3. The presser foot device according to claim 1, wherein the abutting portion is longer than the pair of opposed portions, in the third direction.

4. The presser foot device according to claim 1, wherein the abutting portion is shorter than the pair of opposed portions, in the first direction.

5. The presser foot device according to claim 1, wherein the abutting portion includes a first end portion that is an end portion in the one direction of the first direction, and the first end portion is on the one direction side of the first direction, of an end portion in the one direction of the first direction, of the opposed portions.

6. The presser foot device according to claim 1, wherein the abutting portion includes a specific wall portion and a protruding portion, the specific wall portion is provided on the one direction side of the third direction, of the end surface of the opposed portions, and the protruding portion protrudes from the specific wall portion in a direction toward the center position between the pair of opposed portions, in the second direction, and abuts against the presser foot holder in the second direction.

7. The presser foot device according to claim 6, wherein the protruding portion includes an inclined surface that inclines toward the side in the direction in which the protruding portion protrudes, farther toward another direction that is a direction opposite the one direction of the third direction.

8. The presser foot device according to claim 1, further comprising:

a holder portion holding the wall portion so as to enable the wall portion to move in the first direction, and including an opening that opens toward the one direction of the third direction, both end portions in the second direction of the opening extending in the first direction; and an insertion portion extending from the wall portion in another direction that is a direction opposite the one direction of the third direction, and being inserted into the opening and abutting against both of the end portions of the opening.

9. The presser foot device according to claim 8, wherein the insertion portion is provided in a same position as at least a portion of the abutting portion, in the first direction.

10. The presser foot device according to claim 1, wherein when the abutting portion is mounted on the presser foot holder, at least a portion of the abutting portion is on the one direction side of the first direction, of a presser bar of the sewing machine that holds the presser foot holder.

11. The presser foot device according to claim 1, wherein when the abutting portion is mounted on the presser foot holder, the abutting portion is on another direction side, which is a side in a direction opposite the one direction of the first direction, of an end portion in the one direction of the first direction, of the presser foot holder.

12. The presser foot device according to claim 1, wherein the abutting portion is a pair of the abutting portions provided one on each of the end surfaces of the pair of opposed portions.

13. The presser foot device according to claim 6, wherein the protruding portion includes an inclined surface extending toward another direction that is a direction opposite the one direction of the third direction, and in the direction in which the protruding portion protrudes.

* * * * *